US005108325A

United States Patent [19]

Livingston et al.

[11] Patent Number: 5,108,325

[45] Date of Patent: Apr. 28, 1992

[54] BOAT PROPULSION DEVICE

[75] Inventors: David T. Livingston, Seattle, Wash.; David D. Jones, Mequon, Wis.

[73] Assignee: Brunswick Corporation, Skokie, Ill.

[21] Appl. No.: 672,761

[22] Filed: Mar. 8, 1991

Related U.S. Application Data

[63] Continuation of Ser. No. 436,921, Oct. 11, 1989, abandoned, which is a continuation of Ser. No. 62,449, Jun. 15, 1987, abandoned.

[51] Int. Cl.[5] ..... B63H 25/46

[52] U.S. Cl. ..... 440/112; 440/53; 440/57; 440/61

[58] Field of Search ..... 440/49, 52-54, 440/57, 61, 64, 111, 112

[56] References Cited

U.S. PATENT DOCUMENTS

| | | | |
|---|---|---|---|
| 3,841,257 | 10/1974 | Strang | 115/35 |
| 3,933,116 | 1/1976 | Adams | 440/112 |
| 4,046,096 | 9/1977 | Liaaen | 440/112 |
| 4,201,391 | 5/1980 | Bankstahl | 440/112 |
| 4,370,138 | 1/1983 | Wilka | 440/112 |
| 4,544,362 | 10/1985 | Arneson | 440/112 |
| 4,600,395 | 7/1986 | Pichl | 440/61 |

FOREIGN PATENT DOCUMENTS

| | | |
|---|---|---|
| 854788 | 11/1960 | United Kingdom . |
| 897086 | 5/1962 | United Kingdom . |
| 1422160 | 1/1976 | United Kingdom . |
| 1423930 | 2/1976 | United Kingdom . |
| 2014929 | 9/1979 | United Kingdom . |
| 2092539 | 8/1982 | United Kingdom . |

*Primary Examiner*—Joseph F. Peters, Jr.
*Assistant Examiner*—Clifford T. Bartz
*Attorney, Agent, or Firm*—Lewis L. Lloyd

[57] ABSTRACT

A propulsion device for a boat that mounts through a hole in a bottom surface of the boat. The engine is positioned inside the boat and the propeller drive is positioned under a bottom surface of the boat. The propulsion device includes a mounting assembly, a steering assembly rotatably connecting the drive to the mounting assembly for steering the propeller drive under the boat, a trimming assembly swingingly connecting the drive to the steering assembly for trimming/tilting of the propeller drive under the boat at any steered position, and a drive shaft means providing a drive connection between the engine and the propeller drive at any steered and trimmed position.

26 Claims, 7 Drawing Sheets

BOAT PROPULSION DEVICE

This application is a continuation of application Ser. No. 436,921, filed Oct. 11, 1989, now abandoned, which is a continuation of application Ser. No. 062,449, filed Jun. 15, 1987, now abandoned.

BACKGROUND OF THE INVENTION

This application is related to the following applications and issued patents titled:

L-Drive, U.S. Pat. No. 4,907,994:

Exhaust System for a Boat Propulsion Device, Ser. No. 07/062,227; now abandoned in favor of a continuing application, Ser. No. 07/453,333; filed on Dec. 18, 1989, now abandoned:

Boat Propulsion Device with Internal Exhaust, U.S. Pat. No. 4,911,666: and

Driveshaft Housing for a Boat Propulsion Device Ser. No. 07/062,228, now abandoned.

All of the above first applications or patents were originally filed concurrently on Jun. 15, 1987.

The field of the present invention is a boat propulsion device and more particularly concerns the mounting, steering and trimming/tilting of a boat propulsion device having an engine inside a boat and attaching through a bottom surface of the boat to a drive under the boat which swings under the boat for steering and trimming/tilting.

Prior boat propulsion devices which provide steering and trimming of a drive include the stern drive and the outboard. The stern drive has an engine inside the boat and a drive at the rear of the boat. The outboard is an unit assembly of engine and drive mounted outside the boat. Other prior propulsion devices that have an engine inside the boat and a drive under the boat do not provide the drive with steering and trimming. In U.S. Pat. No. 2,209,302 issued to L. J. Johnson et al steering of a drive and tilting of a drive described. In U.S. Pat. Nos. 2,976,836 and 3,164,122 issued to L. J. Fageol steering and trimming of the entire boat propulsion device as an unit is described.

The stern drive and outboard are satisfactory propulsion devices, but they are large, complex and costly. The other prior drives described above are not particularly desirable since they do not provide an arrangement which provides steering and trimming equivalent to the stern drive.

SUMMARY OF THE INVENTION

In the present invention the mounting arrangement of a boat propulsion device supports a drive under and extending to the rear of the boat to provide an advantageous drive connection vertically through the boat hull. This arrangement achieves an improved orientation of the engine spaced relatively close to the boat transom and results in a more efficient use of the interior of the boat. In fact, the vertical placement of the engine significantly enhances the arrangement of interior seating at the stern of the boat.

Included with the drive positioning under the boat is a steering assembly which accomplishes the steering of the drive on the axis of the vertical engine thereby eliminating the difficulty associated with different axes. Also employed with the drive steering is a trimming assembly which achieves drive trim and tilt under the boat without the necessity of lifting an entire outboard or the equally massive stern drive. The trim is accomplished with a horizontal pivot across which a trim adjusting system changes the trim and tilt angle. The drive transmission with ultimate design simplicity passes through the horizontal pivot with a flexible coupling resulting in a drive transmission configuration not realized with the conventional drives. The drive transmission flexible coupling also is conveniently enclosed and supported by drive shaft bearings.

The device of the present invention provides other advantages in the boat mounting, steering and trim/tilt mechanism which interfaces with the engine and the drive in a manner which simplifies installation and maintenance. The mounting, rotatably on bearings, supports the drive and connects the steering arm inside the boat with easy accessibility for operation from the boat steering system, seals the mounting hole and maintains rigid alignment of the engine to the drive thereby avoiding separate mechanisms compensating for bending of the hull.

DETAILED DESCRIPTION OF THE PREFERRED EMBODIMENT

L-drive

Figure 1A:
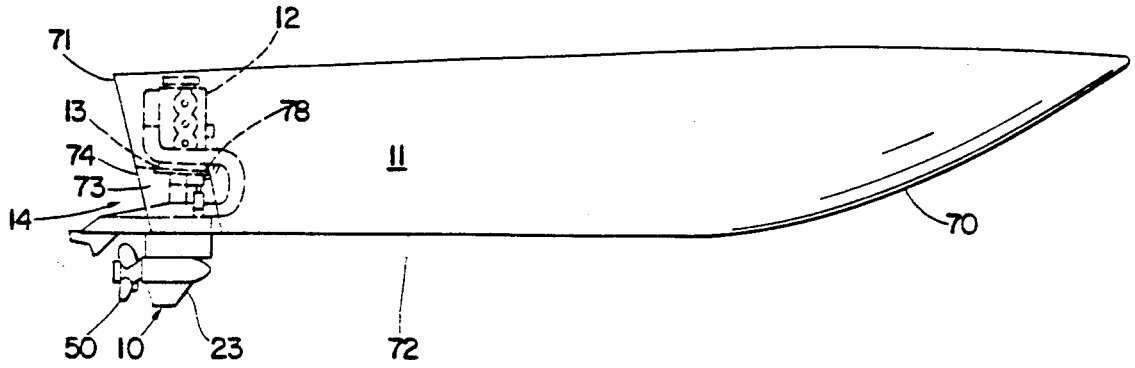
FIG. 1*a* is a general side elevation view of the boat propulsion device of the invention.

A boat propulsion device or L-Drive 10 is shown mounted on a water craft or boat 11 in FIGS. 1 through 6. The boat propulsion device 10 includes an engine 12, a mounting assembly 13 and a propeller drive 14.

The engine 12 may be of either a 2 or 4 cycle internal combustion type. In the preferred embodiment an eighty five horsepower engine as used on the U.S. Marine Force outboard is used. For increased horsepower, the one hundred twenty five horsepower engine as used on the U.S. Marine Force outboard may be used. The engine 12 is prevented from movement by attachment to the mounting assembly 13. In the preferred embodiment the engine 12 is attached with the engine on a vertical axis and connected for power transmission as will be described.

The mounting assembly 13 as shown in FIGS. 2 through 5 includes an engine mounting portion 15 for attachment of the engine 12 to the mounting assembly 13, a boat mounting portion 16 for attachment of the mounting assembly to the boat 11, and a drive mounting portion 17 for attachment of the drive 14 to the mounting assembly 13.

Figure 3:
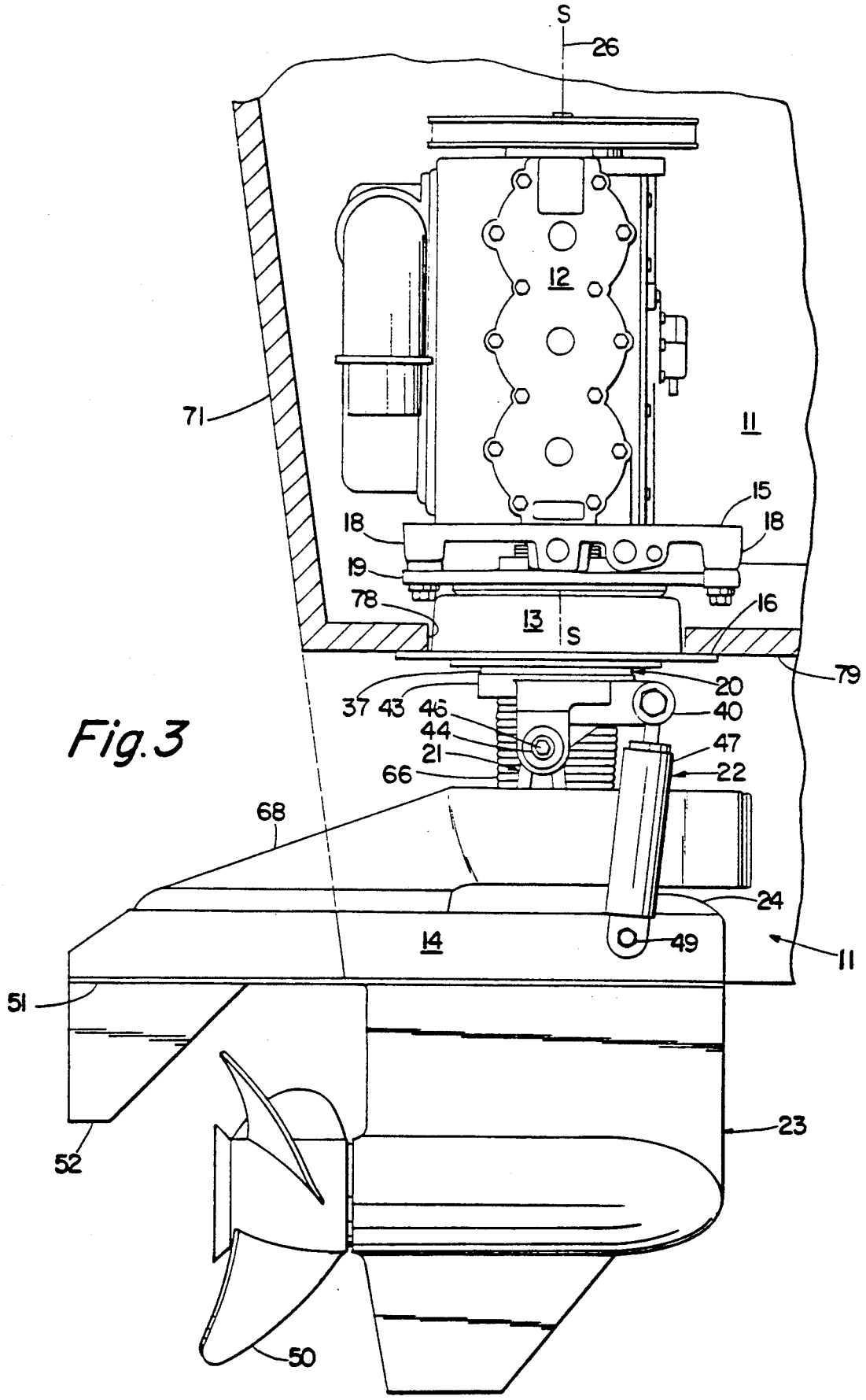
FIG. 3 is a right side elevation view of the boat propulsion device of FIG. 2.
Figure 5:
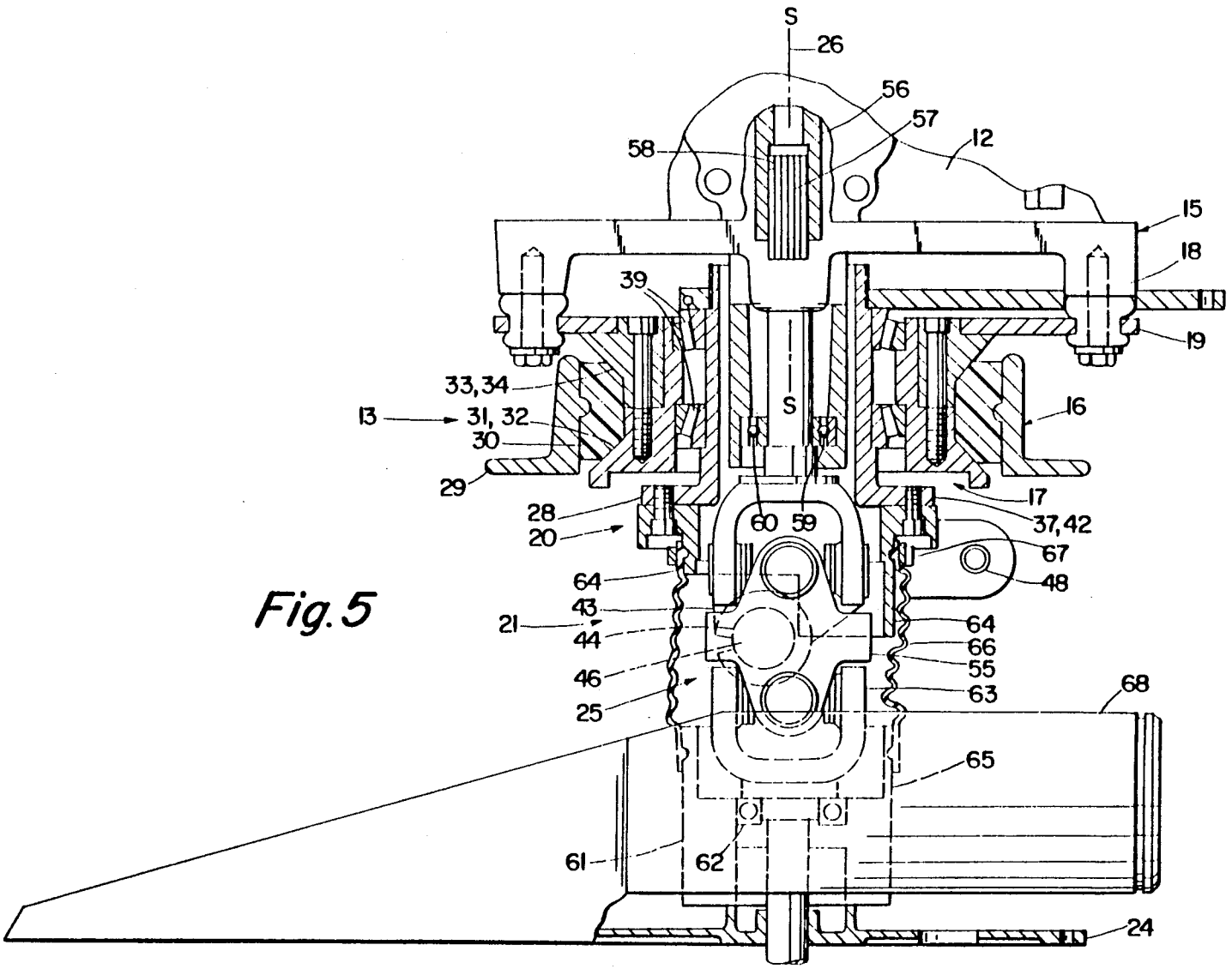
FIG. 5 is a cross-section view of the boat propulsion device as shown in FIG. 3.

The engine mounting portion 16 as shown in FIGS. 3 and 5 is a spaced set of four engine pads or mounts 18 which extend or project downward from the engine adapter plate 19. The adapter plate 19 includes a mounting bolt pattern (not shown) which matches the attachment bolt pattern (not shown) on the engine 12 to align the engine crankshaft.

The drive 14 as shown in FIG. 2 through 5 includes a steering assembly 20, a trimming assembly 21 with a trim adjusting system 22, a propeller drive lower unit 23, a lower unit adapter 24, and a drive shaft means 25. The drive 14 rotates from side-to-side about a vertical axis 26 or S—S in the mounting assembly 13 to steer and pivots up-and-down about a horizontal axis 27 or T—T to trim/tilt.

The boat mounting portion 16 includes a central member 28, a boat connecting member or mounting flange 29, and a resilient member 30 between the central member 28 and the mounting flange 29. The central member 28 has a lower portion 31 forming a lower clamping surface 32 and an upper portion 33 forming an upper clamping surface 34. The mounting flange 29 has an inner retaining surface 35 and an outer mounting flange surface 36. The resilient member 30 is positioned clamped between the lower clamping surface 32, the upper clamping surface 34 and the inner retaining surface 35. The resilient member 30 generally supports the L-Drive 10 and provides a limited amount of vibration isolation. The flange surface 36 attaches to the boat 11. The drive mounting portion 17 is the steering member 37 which is rotatably supported in spaced bearings 38 in the central member 28 shown in FIGS. 5 and 6.

The steering assembly 20 includes a steering member 37 and a steering arm 40 for rotating the steering member 37 to steer the boat 11. The steering member 37 as shown in FIGS. 3 and 5 is formed with an upper generally tubular portion or hollow spindle 42 which extends up through the mounting assembly 13 to a position above the mounting assembly 13 and within the engine mounting portion 15. The steering member 37 rotates on the axis S—S.

Figure 2:
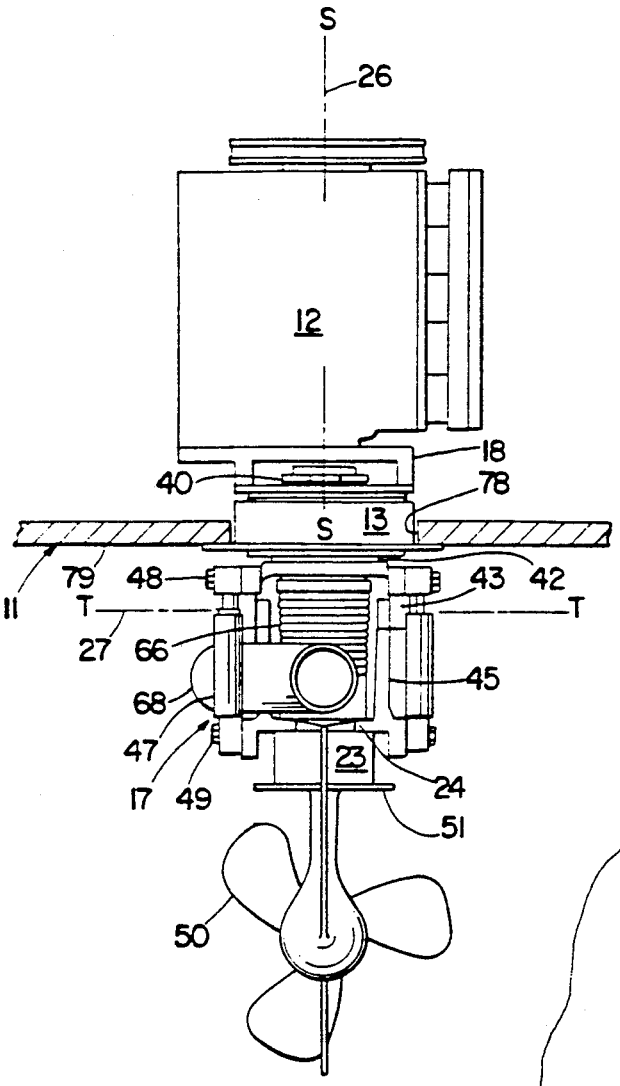
FIG. 2 is a front elevation view of the boat propulsion device of the invention.

The steering arm 40 is attached to the top of the hollow spindle 42 of the steering member 37 with a key or spline (not shown) so that they rotate as one unit. The steering arm 40 extends out generally horizontal from the hollow spindle 42 within the engine mounting portion 15 between two of the engine mounts 18 as shown in FIG. 2. The two engine mounts 18 are positioned spaced to provide rotational steering range for the steering arm 40 and the height of the engine mounts 18 also provides height clearance for the steering arm 40. The steering arm 40 is connected with a boat steering system which rotates the steering member 37 to steer the drive 14.

The steering assembly 20 also includes a lower depending portion, yoke or downward trunnion 48 which provides the horizontal trimming pivot 44 for the trimming assembly 21.

The trimming assembly 21 includes an upward trunnion 43 on the lower unit adapter 24 which pivotally mounts the adapter 24 to the downward trunnion 45 on the steering member 37 at trimming pivot 44. The overlapping or engaging sides of the trunnions 43 and 45 each contains a pivot pin 46 at trunnion pivot 44. The trimming assembly 21 also utilizes a trim adjusting system 22 which includes a hydraulic trim cylinder 47 on each side of the drive 14 connected between a cylinder upper pivot 48 on the steering member 37 and a cylinder lower pivot 49 on the lower unit 23. Operation of the hydraulic trim cylinder 47 pivots the drive 14 up-and-down about aligned pivot pins 46 for trim/tilt. Although two trim cylinders 47 are shown, one cylinder 47 may be used.

Figure 4:
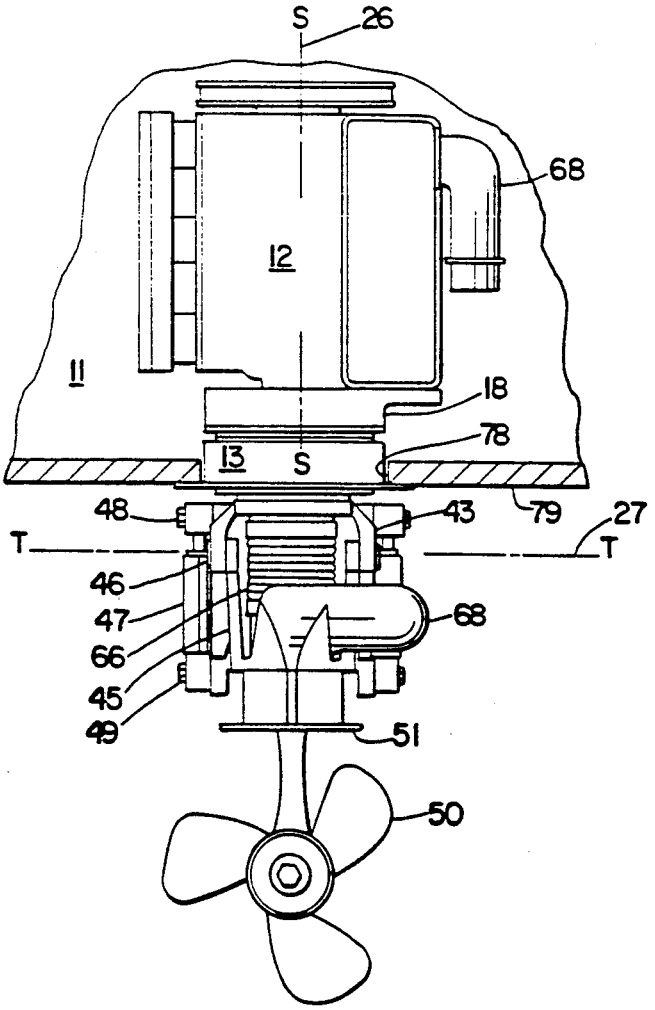
FIG. 4 is a back elevation view of the boat propulsion device of the invention.

The lower unit 23 as shown in FIG. 2 through 4 includes the propeller 50, a propeller shaft including reversing clutch and gearing (not shown), an anticavitation plate 51 and a trim fin 52 under the anticavitation plate 51. The lower unit 23 is of known construction used in an outboard. The preferred lower unit 23 is an eighty-five horsepower lower unit used in the Force Outboard.

The lower unit adapter 24 as shown in FIG. 5 mounts to the top of the lower unit 23 to detachably interface or adapt from the lower unit 23 to the trimming assembly 21 at the trimming pivot 44.

Figure 6:
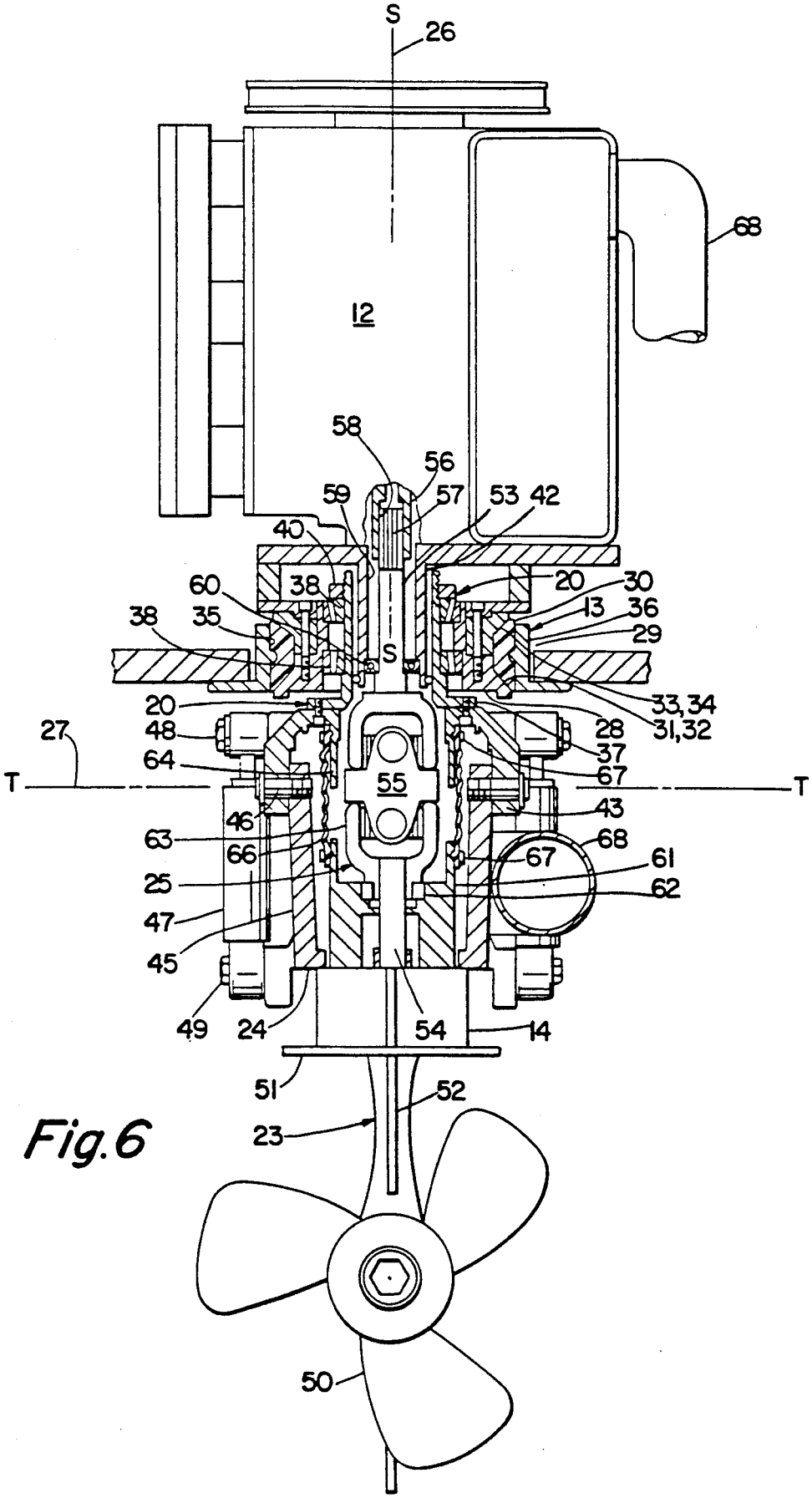
FIG. 6 is a cross-section view of the boat propulsion device as shown in FIG. 2.

The drive shaft means 25 as shown in FIGS. 5 and 6 includes a first or upper vertical drive shaft 53, a second or lower drive shaft 54, and a flexible coupling or universal joint 55 connecting adjacent ends of the drive shafts 53 and 54. The upper drive shaft 53 is between the engine crankshaft 56 and the trimming pivot 44 and the lower drive shaft 54 is between the trimming pivot 44 and the lower unit 23 attaching to the lower unit gearing (not shown) as is known. The upper drive shaft 53 includes an external spline 57 which slidably engages the internal spline 58 in the engine crankshaft 56. The lower drive shaft 54 is generally vertical when the propeller shaft is horizontal. The upper drive shaft 53 is positioned on the vertical axis S—S. The lower driveshaft 54 angles down from the upper drive shaft 53 at the universal joint 55 during trim/tilt. The upper and lower drive shafts 53 and 54 are coplanar with a plane that is perpendicular to the axis T—T of the trimming pivot 44.

A drive shaft upper bearing support 59 is also provided as a depending portion of the engine mounting portion 15. The upper bearing support 59 is formed as a hollow member extending downward from the adapter plate 19 into the space between the hollow spindle 42 and the upper drive shaft 53. The lower end of the upper support 59 contains an upper shaft bearing 60 positioned adjacent the universal joint 55 for support of the upper drive shaft 53. The upper shaft bearing 60 aligns the upper drive shaft 53 with the engine crankshaft 56.

A lower driveshaft bearing support 61 is also provided as a hollow member extending upward from the lower unit adapter 24 into the space between the upward trunnion 45 and the lower drive shaft 54. The upper end of the upper bearing support 59 contains a lower drive shaft bearing 62 positioned adjacent the universal joint 55 for support of the lower drive shaft 54.

The steering assembly and trimming assembly generally include a central passageway therein forming a closed compartment or enclosure 63 around the drive shaft means 25 and particularly the universal joint 55 as shown in FIG. 5. The enclosure 63 extends from within the steering member 37 down to within the lower unit adapter 24. A tubular upper end portion 64 within the steering member 37 forms the upper portion of the enclosures 63 and a tubular lower end portion 65 between the upward trunnion 45 forms a lower end of the enclosure 63. A flexible cover or universal joint bellows 66 extends between the upper end portion 64 and the lower end portion 65 to cover the universal joint 55. The bellows 66 is a resilient tubular connector which is slipped over the end portions 64 and 65 and fastened therewith by a hose clamp 67. The enclosure protects the universal joint 55 from water.

The L-Drive 10 also includes a shift assembly (not shown) for operating the clutch (not shown) in the lower unit 23, an engine water cooling system including a drive shaft driven pump (not shown) and an engine exhaust system 68.

The Boat

Figure 1B:
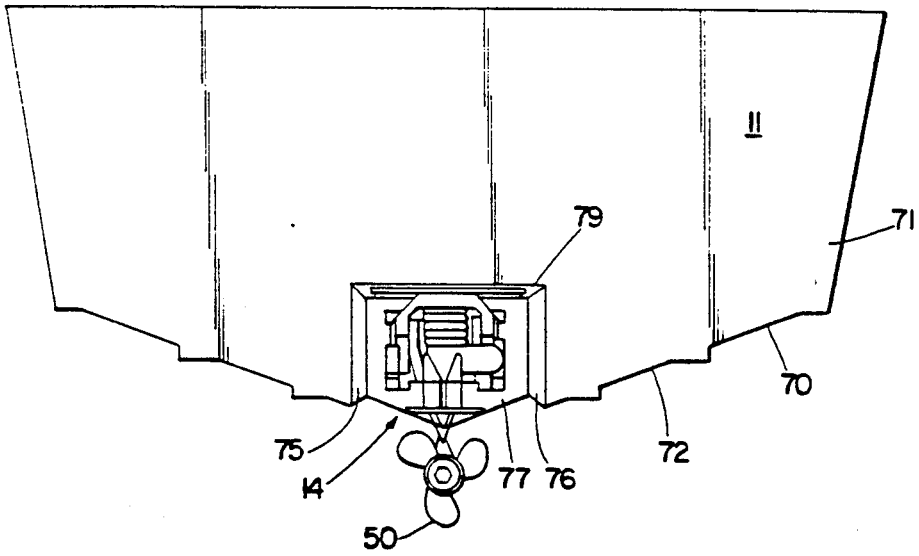
FIG. 1*b* is a general end elevation view of the boat propulsion device and boat of FIG. 1*a*.
Figure 1C:
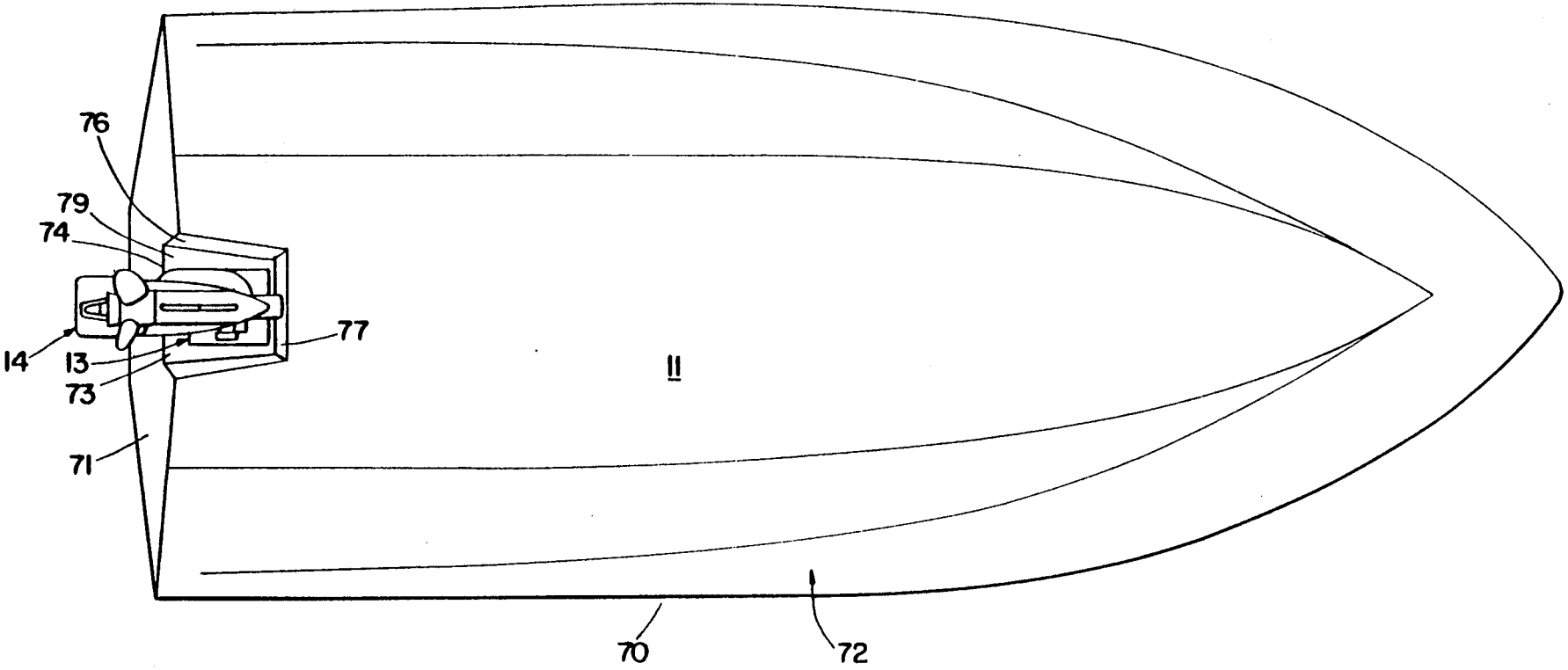
FIG. 1*c* is a general bottom elevation view of a boat propulsion device and boat of FIG. 1*a*.

The boat 11 as shown in FIGS. 1*a*, 1*b*, and 1*c* includes a planing hull 70 and a generally vertical upright transom 71. The hull 70 includes a bottom planing surface 72 and cavity 73 adjacent the transom 71. The cavity 71 extends upwardly into the hull 70 and has an open end extending through a notch 74 in the transom 71.

The cavity 73 includes a first portside wall 75, a second starboard side wall 76 and a third forward wall 77. The forward wall 77 is preferably vertically upright similar to the transom 71. The forward wall 77 is positioned as far rearward as possible against the drive 14 to provide maximum bottom planing surface 72 forward of the drive 14. A hole 78 as shown in FIG. 4 is formed in the top 79 of the cavity 73 to attach the mounting assembly 13.

Operation of the Steering and Trimming System

Steering and trimming of the L-Drive 10 is easily accomplished. To steer the boat 11, the driver turns the boat steering wheel which operates the boat steering system to turn the drive 14. To trim the boat 11, the operator operates the boat hydraulic system to power the hydraulic trim cylinder 47 to lift or lower the drive 14. The steering of the drive 14 is about the horizontal axis T—T. The steering is totally independent from the trimming or tilting. In other words, the operator can steer at any trim position and the operator can trim at any steered position.

Figure 7:
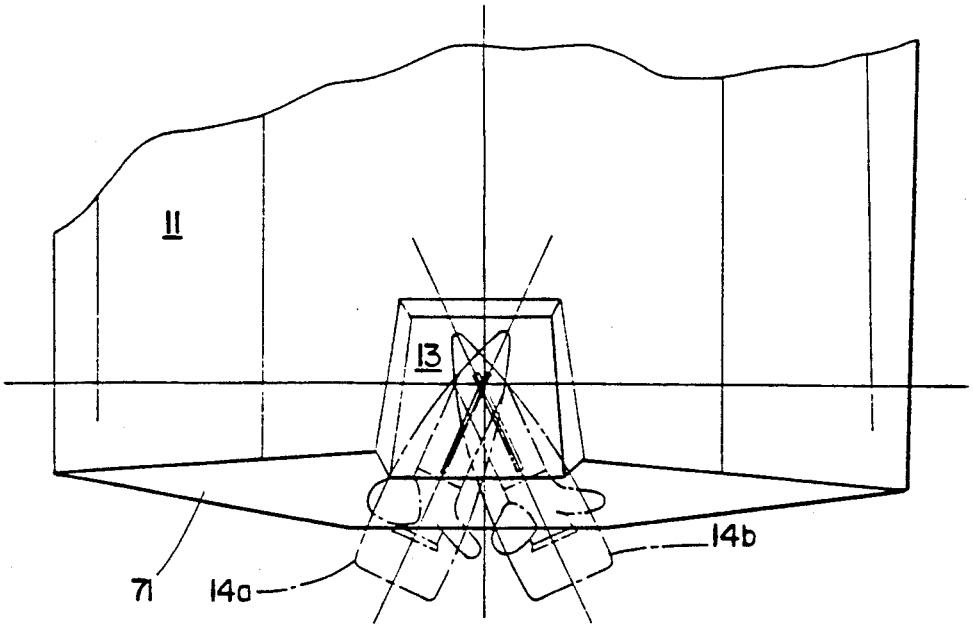
FIG. 7 is a fragmentary bottom elevation view similar to FIG. 1*c* showing the steering range of the boat propulsion device.

The steering of the drive 14 is further described with respect to FIGS. 3 and 5. When the steering arm 40 is moved by the steering system of the boat 11, it rotates the steering member 37 to steer the drive 14. Steering the drive 14 redirects the propeller thrust. The redirected propeller thrust changes the direction of the boat 11 thereby directing or steering the boat in the desired path. In FIG. 7 (a bottom elevation view), the drive 14*a* (shown in phantom lines) illustrates steering to starboard and the drive 14*b* (shown in phantom lines) illustrates steering to port.

Figure 8:
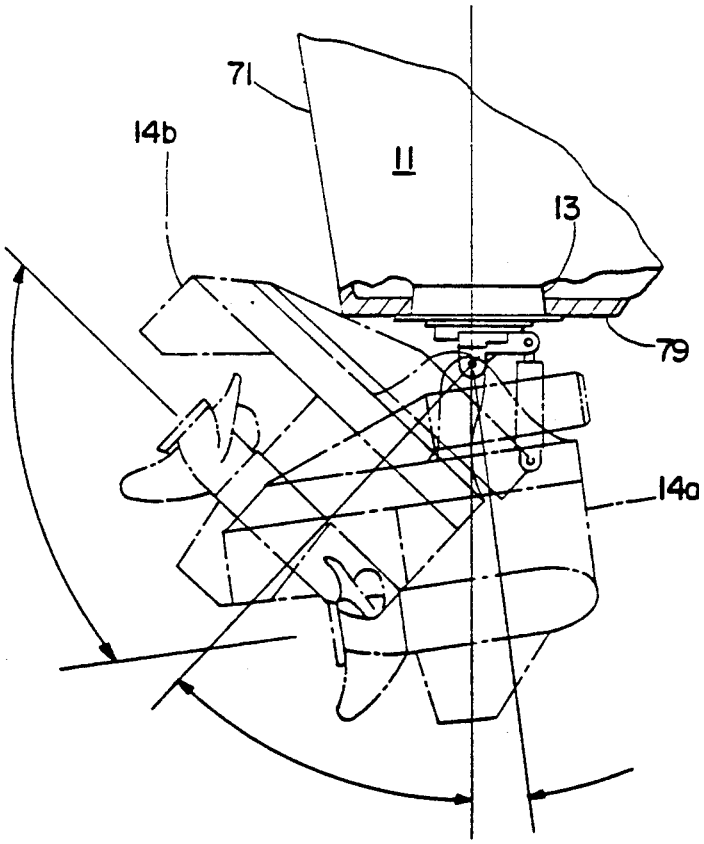
FIG. 8 is a fragmentary side elevation view similar to FIG. 1*a* showing the trim/tilt range of the boat propulsion device.

The trimming of the drive is further described with respect to FIG. 8. When the drive 14 is being trimmed it swings up-and-down about the horizontal pivot axis 27 or T—T. Swinging of the drive 14 changes the angle of the propeller thrust direction to lift or lower the bow of the boat. The range of angular direction of the propeller thrust from a boat stopped condition to an on plane condition generally defines the range of trim. The range of tilt is upwardly from the maximum up or out trim position to the highest position available. The tilt range is used to change the propeller and to lift the drive 14 when removing the boat 11 from the water on a trailer of for transporting storage. The propeller thrust is generally not used or available i the tilt-range therefore steering does not occur. In FIG. 8, the drive 14*a* (shown in phantom) shows a generally operating trim position and the drive 14*b* (shown in phantom) shows a generally up-tilt position.

While an embodiment and application of the invention has been shown and described, it would be apparent to those skilled in the art that modifications are possible without departing from the invention concepts herein. Therefore, the invention is not to be restricted other than by the scope and equivalency of the following claims.

We claim:

1. A propulsion device for a boat having a bottom surface comprising an engine for positioning inside the boat, a propeller drive for positioning under said bottom surface of said boat a mounting assembly for mounting within said bottom surface of said boat between said engine and said drive, said mounting assembly including a central member portion, a steering assembly rotatably connecting said drive to said mounting assembly, said steering assembly having a tubular portion extending upwardly through said mounting assembly, said steering assembly rotating within said mounting assembly about a generally vertical axis, a trimming system for connecting the drive to said steering assembly for providing a limited range of horizontal swinging movement therefrom, and a driveshaft means drivably coupling said drive to said engine.

2. The propulsion device defined in claim 1 wherein said central member portion and said tubular portion include a cooperating bearing support, and said steering assembly includes a bearing within said cooperating bearing support, said bearing rotatably supporting said tubular portion of said steering assembly in said central member for rotation therein about said generally vertical axis.

3. The propulsion device defined in claim 1 wherein said drive shaft means includes an upper drive shaft drivably connected through said mounting assembly, said upper drive shaft positioned through a drive shaft passageway formed in said tubular portion of said steering assembly, whereby said tubular portion with said driveshaft passageway rotates.

4. The propulsion device defined in claim 3 wherein said upper drive shaft and said tubular portion are concentrically positioned for relative rotation with respect to said mounting assembly, whereby said tubular portion rotates during steering and whereby said drive shaft rotates to provide drive power transmission to said propeller drive.

5. A propulsion device for a boat having a bottom surface comprising an engine for positioning inside the boat, a propeller drive for positioning under a bottom surface of said boat, a mounting assembly for mounting within said bottom surface of said boat between said engine and said drive, a steering assembly rotatably connecting said drive to rotate within said mounting assembly on a generally vertical axis, said steering assembly having a depending portion for horizontally pivotably connecting to said drive, said steering assembly having a drive shaft passageway therein, a trimming assembly having an upwardly extending portion for said horizontally pivotably connecting with said steering assembly, said trimming assembly supporting said drive for providing horizontal swinging movement thereof on a generally horizontal axis whereby said steering assembly rotates within said mounting assembly for steering of said drive and whereby said trimming assembly rotates as an unit with said steering assembly on said generally vertical axis during steering and further swings on said generally horizontal axis during trimming.

6. The propulsion device defined in claim 5 wherein said steering assembly and said trimming assembly have a common passageway therebetween, said passageway forming a driveshaft enclosure.

7. The propulsion device defined in claim 6 further including a lower end portion within said depending portion, an upper end portion within said upwardly extending portion and a drive shaft flexible housing sealably connected between said upper end portion and lower end portion.

8. A propulsion device for a boat having a bottom surface comprising an engine for positioning inside the boat, a propeller drive for positioning under said bottom surface of said boat, a mounting assembly for mounting within said bottom surface of said boat between said engine and said drive, a steering assembly having a trimming assembly mounted thereto, said steering assembly connecting said drive to rotate on a generally vertical axis within said mounting assembly for generally vertical rotation for steering, said trimming assembly providing for generally horizontal rotation for trimming, said steering and trimming assembly including a drive shaft passageway means providing a sealed enclosure within said steering and trimming assembly during said trimming, and a drive shaft means drivably coupling said engine with said drive through said drive shaft passageway means.

9. The propulsion device defined in claim 8 wherein said drive shaft means includes an upper drive shaft, a lower drive shaft and an universal joint connecting said upper and lower drive shafts, said upper and lower drive shafts and said universal joint positioned within said drive shaft passageway means for providing drive power transmission therethrough during said steering and said trimming, whereby said lower drive shaft bends with respect to said upper drive shaft on a generally horizontal axis at said universal joint during said trimming of said drive.

10. The propulsion device defined in claim 9 wherein said universal joint is positioned within a flexible portion of said steering and trimming assembly, said flexible portion providing flexing during said trimming, whereby said flexible portion flexes in the bending direction of said lower driveshaft.

11. A propulsion device for a boat having a bottom surface comprising an engine for positioning inside the boat, a propeller drive for positioning under said bottom surface of said boat, a mounting assembly for mounting within said bottom surface of said boat between said engine and said drive, said mounting assembly including a boat mounting portion for mounting with the boat and a drive mounting portion having a central member for mounting with the drive, a steering assembly for connecting said drive to said mounting assembly, said steering assembly constructed to rotate about a generally vertical axis within said mounting assembly, a trimming assembly for connecting the drive to said steering assembly for providing a limited range of horizontal swinging movement therefrom, and a drive shaft means drivably coupling said engine to said drive, said drive shaft means including an upper drive shaft drivably connecting through said mounting assembly coaxial with said generally vertical axis.

12. The propulsion device defined in claim 11 wherein said drive mounting assembly includes a boat connector for attaching to a boat bottom surface, and a retaining member removably positioned between said drive mounting assembly and the boat connector.

13. The propulsion device defined in claim 12 wherein the retaining member is resilient for providing sealing and vibration isolation from the device to the boat.

14. The propulsion device defined in claim 12 wherein one of the central member and boat connector include two opposing portions which clamp said retaining member therebetween; one of said opposing portions being removable to disengage said central member from said boat connector.

15. A propulsion device for a boat comprising an engine for positioning inside the boat, said engine positioned with the crankshaft vertical and output end of crankshaft down, a propeller drive for positioning under a bottom surface of the boat, a mounting assembly between said engine and said drive, said mounting assembly including an engine mounting portion for mounting the engine, a steering assembly for connecting said drive to said mounting assembly, said steering assembly constructed to rotated about a generally vertical axis with said mounting assembly, said steering assembly including a steering member having a steering arm fixed thereto, a trimming system for connecting the drive to said steering assembly for providing a limited range of horizontal swinging movement therefrom, and a drive shaft means drivably coupling said engine with said drive, said drive shaft means including an upper drive shaft drivably connecting through said mounting assembly coaxial with said generally vertical axis.

16. The propulsion device defined in claim 15 wherein said engine mounting portion includes upwardly extending mounts providing vertical height clearance and rotational clearance therebetween to permit turning of said steering arm within a desired steering range.

17. The propulsion device defined in claim 15 wherein said drive shaft means includes an upper drive shaft coaxial to said vertical steering axis, said drive shaft coaxially coupling with said output end of said engine crankshaft.

18. The propulsion device defined in claim 17 wherein said coupling is within said engine mounting portion.

19. The propulsion device defined in claim 17 wherein said coupling is an internal spline within said crankshaft output end and an engaging external spline on the upper end of said driveshaft.

20. The propulsion device defined in claim 16 wherein said engine mounting portion includes an engine adapter member removably attached between said upwardly extending mounts and said engine.

21. A propulsion device for a boat comprising an engine for positioning inside the boat, said engine positioned with the crankshaft vertical and output end of crankshaft down a propeller drive for positioning under a bottom surface of the boat, a mounting assembly between said engine and said drive, said mounting assembly including an engine mounting portion for mounting the engine, a steering assembly for connecting said drive to said mounting assembly, said steering assembly constructed to rotate about a generally vertical axis with said mounting assembly, said steering assembly including a steering member having a steering arm fixed thereto, said engine mounting portion including upwardly extending mounts providing vertical height clearance and rotational clearance between said engine and said drive to permit turning of said steering arm within a desired steering range, a drive shaft means drivably coupling with said drive, said drive shaft means including an upper drive shaft drivably connecting through said mounting assembly coaxial with said generally vertical axis, and an universal joint connected at the lower end of said upper drive shaft, said universal joint providing a drive angle change.

22. A propulsion device for a boat comprising an engine for positioning inside the boat, a propeller drive for positioning under a bottom surface of the boat, a mounting assembly constructed to be mounted at a generally horizontal surface of said boat between said engine and said drive, a steering and trimming assembly, said steering assembly rotatably connecting said drive to said mounting assembly, said steering assembly having a depending first trunnion, said trimming assembly connecting said drive to said steering assembly and having an upwardly extending second trunnion, said first trunnion engaging with said second trunnion at a common horizontal pivot means for providing swinging upward movement of said drive, said steering and trimming assembly having a drive shaft enclosure therein, and a drive shaft means including an upper drive shaft, a lower drive shaft, an universal joint connecting said upper and lower drive shafts, said upper and lower drive shafts and said universal joint positioned within said drive shaft enclosure.

23. The propulsion device defined in claim 22 wherein said upper and lower drive shafts are rotatably supported by a drive shaft bearing within said enclosure whereby said support provided by said drive shaft bearing is adjacent said universal joint.

24. The propulsion device defined in claim 23 wherein said enclosure adjacent said universal joint is a flexible bellows tubular connector, said tubular connector bending without touching said universal joint during swinging of said drive about said horizontal pivot means to trim whereby said bending occurs only about a horizontal axis defined by said horizontal pivot means.

25. A propulsion device for a boat comprising and engine for positioning inside the boat, a propeller dirve for positioning under a bottom surface of the boat, said drive having a first trim cylinder mounting pivot, a mounting assembly between said engine and said drive.

a steering member supporting said drive within said mounting assembly for rotation about a generally vertical axis, said steering member having a second trim cylinder mounting pivot under said mounting assembly, a trimming asembly for connecting said drive to said steering member for rotation about a generally horizontal axis, said trimming assembly operatively rotating said drive about said generally horizontal axis for changing the trim angle, and a drive shaft means drivably coupling said engine with said drive.

26. The propulsion device defined in claim 25 wherein said first and second trim cylinder mounting pivots are positioned and connected by said trim cylinder means with a trim cylinder means retracted at full in-trim condition, said cylinder means extending to lift said drive.

* * * * *